US006887310B2

(12) United States Patent
Hwu et al.

(10) Patent No.: US 6,887,310 B2
(45) Date of Patent: May 3, 2005

(54) HIGH-K GATE DIELECTRICS PREPARED BY LIQUID PHASE ANODIC OXIDATION

(75) Inventors: Jenn-Gwo Hwu, Taipei (TW); Yen-Po Lin, Taipei (TW); Szu-Wei Huang, Taipei (TW)

(73) Assignee: National Taiwan University, Taipei (TW)

( * ) Notice: Subject to any disclaimer, the term of this patent is extended or adjusted under 35 U.S.C. 154(b) by 281 days.

(21) Appl. No.: 10/196,380

(22) Filed: Jul. 17, 2002

(65) Prior Publication Data

US 2004/0011656 A1 Jan. 22, 2004

(51) Int. Cl.[7] ..... C30B 25/12; C30B 25/14

(52) U.S. Cl. ..... 117/2; 117/3; 438/591; 438/678; 438/785

(58) Field of Search ..... 117/2, 3; 438/591, 438/678, 785

(56) References Cited

U.S. PATENT DOCUMENTS 6,300,203 B1 * 10/2001 Buynoski et al. ..... 438/287
6,465,334 B1 * 10/2002 Buynoski et al. ..... 438/591
6,559,051 B1 * 5/2003 Buynoski et al. ..... 438/678

* cited by examiner

*Primary Examiner*—Felisa Hiteshew

(57) ABSTRACT

A method of preparing high-k gate dielectrics by liquid phase anodic oxidation, which first produces a metallic film on the surface of a clean silicon substrate, next oxidizes the metallic film to form a metallic oxide as a gate oxidizing layer by liquid phase anodic oxidation, then promoting quality of the gate oxidizing layer by processing a step of thermal annealing. With this oxidation, a gate dielectric layer of high quality, high-k and ultrathin equivalent oxide thickness (EOT) can be produced, which can be integrated into a complementary metal oxide semiconductor (CMOS) production process directly.

20 Claims, 4 Drawing Sheets

HIGH-K GATE DIELECTRICS PREPARED BY LIQUID PHASE ANODIC OXIDATION

BACKGROUND OF THE INVENTION

The present invention relates to a method of preparing high-k gate dielectrics by liquid phase anodic oxidation, and more particularly to a method of using liquid phase anodic oxidation to produce a gate dielectric layer of high quality, high-k (k being the dielectric constant) and ultrathin equivalent oxide thickness (EOT), which can be integrated with a complementary metal oxide semiconductor(CMOS) process directly.

The present technology of complementary metal oxide semiconductor processes has reached to the times of deep sub-micron devices. The more advanced nanotechnology processes(<100 nm) also have been researched and developed to a point where it is rapidly becoming close to where manufacturing will be implemented. Following the continuous advancements in process techniques of this technology, the gate-oxidizing layer of the transistor is getting thinner. Though the advantages of prior silicon dioxide can't be replaced, the leakage current in the accumulation region follows a trend of exponential growth with the reduction of thickness. Therefore, high-k materials need to be researched and developed as gate oxidizing layers. A high-k gate oxidizing layer has lower leakage current compared with the same equivalent oxide thickness and very possibly will replace silicon dioxide to be a gate oxidizing layer of the transistor in the next generation.

The general prior art for the production of a thin high-k metal oxidizing layer chiefly include thermal oxidation, molecular beam epitaxy(MBE), chemical vapor deposition (CVD) and atomic layer deposition (ALD). Therein thermal oxidation requires depositing a layer of metal or a compound containing the metal on the substrate and then producing the metal oxidizing layer by thermal oxidation. Though the traditional method is easy and convenient, the processing must be performed at a high temperature. The metal oxidizing layer can be produced on the substrate directly by MBE, CVD or ALD, instead of expensive installations used to form a high vacuum environment under high temperature.

With regard the technology of 0.13 $\mu$m (micron) processing being used in the manufacturing, the thickness of a gate oxidizing layer of a transistor is about equal to 24 Å. When the thickness of a gate oxidizing layer is smaller than 30 Å, isolation of a gate oxidizing layer will be much influenced by the direct tunneling effect, which results in the incremental increase of leakage current of a oxidizing layer to cause power dissipation of the transistor in the closed situation and the possibility of a wrongly switched circuit. When devices are minimized, the current driving ability of the transistors decreases. From the current formula of the metal oxide semiconductor field effect transistor (MOSFET), $$I_d = \tfrac{1}{2} \cdot \mu C_{OX} \cdot W/L\ (V_{gs} - V_t)^2$$

wherein, $I_d$ means drain current, $\mu$ means channel mobility, $C_{OX}$ means capacitance of oxidizing layer, W means channel width, L means channel length, $V_{gs}$ means voltage of gate corresponds to source, $V_t$ means threshold voltage.

We know that if we want to increase the current of the transistor, we must first increase $C_{OX}$ so as to keep a stable current-driving ability while the characterized size of devices are minimized.

To solve the foregoing problems, it is required to increase physical thickness and value of dielectric constant so as to decrease leakage current of an oxidizing layer and to increase $C_{OX}$. Therefore, using high-k materials to replace silicon dioxide as gate oxidizing layers is a necessary trend. The high-k gate oxidizing layers also calls for high-k gate dielectrics.

It has therefore been tried by the inventor to develop a method of preparing high-k gate dielectrics by liquid phase anodic oxidation, which first produces a metallic film on the surface of clean silicon substrate, next oxidizes said metallic film to form a metallic oxide as a gate oxidizing layer by liquid phase anodic oxidation, and then promotes quality of the gate oxidizing layer by performing a step of thermal annealing. With this oxidation, a gate dielectric layer of high quality, high-k and ultrathin equivalent oxide thickness can be produced, which can be integrated with the complementary metal oxide semiconductor process directly.

SUMMARY OF THE INVENTION

A primary object of the present invention is to provide a method of high-k gate dielectrics prepared by liquid phase anodic oxidation, which first produces a metallic film on the surface of clean silicon substrate, next oxidizes said metallic film to form a metallic oxide as a gate oxidizing layer by liquid phase anodic oxidation, and then promotes quality of said gate oxidizing layer by processing a step of thermal annealing. With this oxidation, a gate dielectric layer of high quality, high-k and ultrathin equivalent oxide thickness can be produced, which can be integrated with a complementary metal oxide semiconductor process directly.

Another object of the present invention is to provide a method of producing a metal oxide semiconductor field effect transistor that contains high-k gate dielectrics, which first produces the p-well and the n-well in a silicon substrate and fills an oxide for isolation. According to the method a metallic film then is produced on the surface of said clean silicon substrate and said metallic film is oxidized to form a metallic oxide as a gate-oxidizing layer by liquid phase anodic oxidation. Next, quality of said gate oxidizing layer is promoted by performing a step of thermal annealing so as to form a gate layer on the gate metal oxidizing layer. The gate region is defined and the gate, drain and source of the transistor are formed by ion implantation. Then an oxide-isolating layer is deposited on the gate layer. After etching the window of the gate, drain and source, a contact wire is deposited. The concentration of junction traps is decreased by using thermal annealing so as to produce a metal oxide semiconductor field effect transistor that contains high-k gate dielectrics.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Embodiment 1

Figure 1:
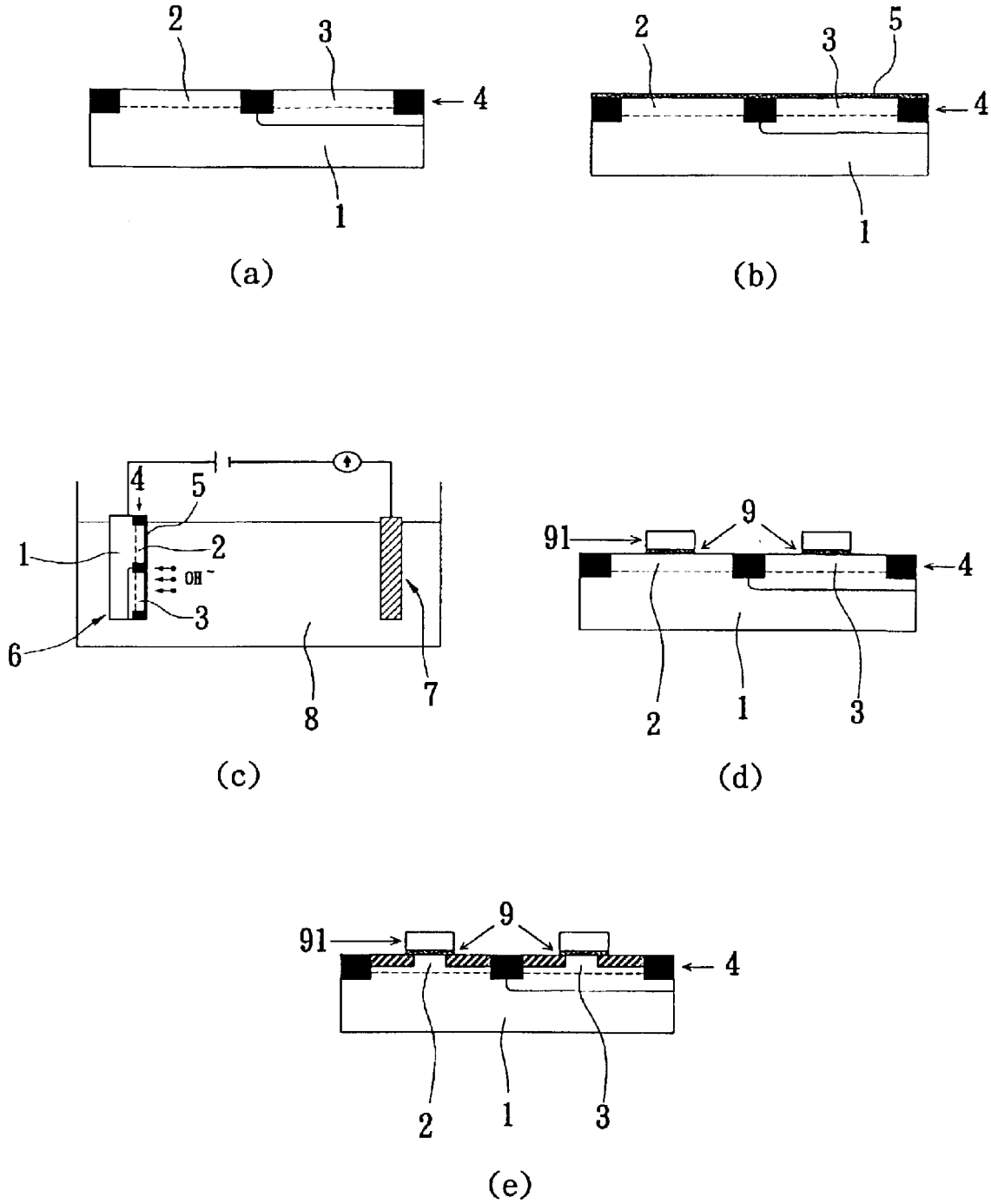
FIG. 1 is a diagram that shows the process of producing high-k gate dielectrics that can be integrated with a complementary metal oxide semiconductor process ($Al_2O_3$, for example)

Please refer to FIGS. 1(*a*)~(e), which are diagrams that show the process of producing high-k gate dielectrics that can be integrated with a complementary metal oxide semiconductor process($Al_2O_3$, for the example). As shown, to oxidize a metal to form a metallic oxide by liquid phase anodic oxidation so as to produce a high-k gate dielectric, the first step of the process is producing the p-well 2 and the n-well 3 inside the P-type substrate and filling an oxide 4 for isolation (as shown in FIG. 1(*a*)). Then a layer of ultrathin metallic aluminum film 5 is deposited on a clean P-type substrate 1 by evaporation or sputtering (as shown in FIG. 1(*b*)). Next, the metal is oxidized to form a metallic oxidizing layer by liquid phase anodic oxidation (see FIG. 1(*c*), where anode 6 is the P-type substrate 1, cathode 7 is a platinum sheet, electrolyte 8 is DI water or other organic, inorganic electrolyte). And to promote quality of the oxidizing layer, annealing (not shown) is performed to form a gate aluminum oxide 9. Finally, a poly-silicon gate 91 is produced to work out a high-k gate dielectric (as shown in FIGS. 1(*a*)~(e)).

Embodiment 2

Figure 2:
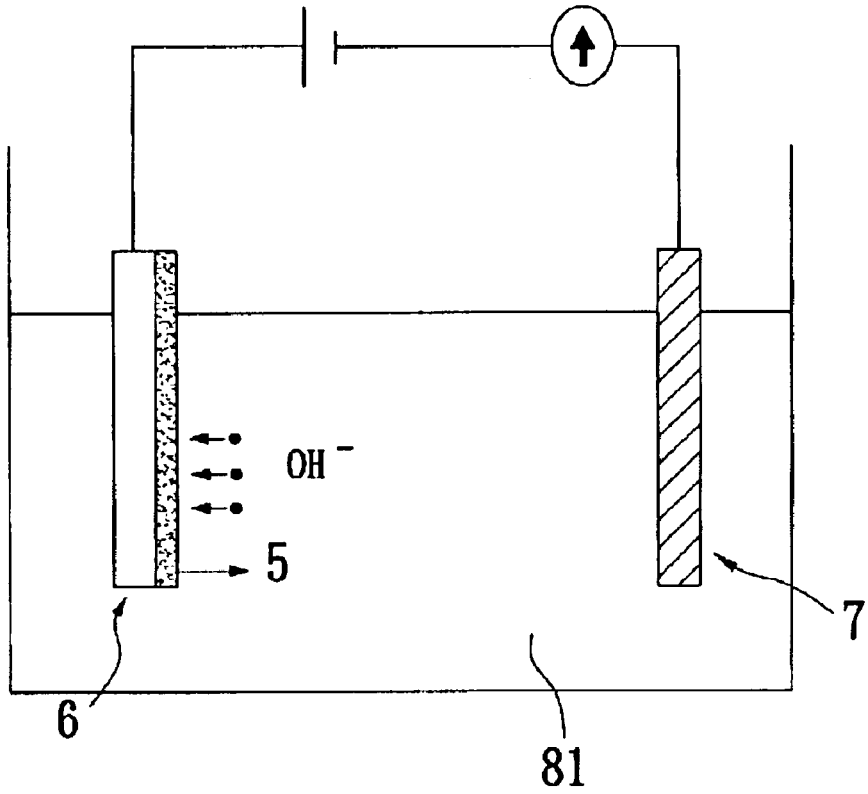
FIG. 2 is a diagram that shows the composition of liquid phase anodic oxidation.

Next to be described is an example of preparing metal oxide semiconductor diode (MOS diode) by direct current anodic oxidation in DI water 81. As described in the foregoing preparing steps, first a 15 Å pure aluminum film (99.9999%) is deposited on a clean silicon substrate by evaporation. Then direct current anodic oxidation is performed in DI water 81 using a value of electric field of 7.143 V/cm and an oxidizing time of 6.5 minutes, as shown in FIG. 2. Thereafter, annealing is performed at a high temperature by using a furnace that burns nitrogen gas, and the annealing temperature is 650° C., the annealing time is 60 seconds, and the result is the preparation of the oxidizing layer whose gate is an aluminum metal that is produced by evaporation (3000 Å). After that, the gate area ($2.25\cdot10^{-4}$ cm$^2$) is defined by photolithography and finally aluminum metal is again evaporated as a back contact of a wafer to finish fabrication of whole single device. The EOT of the aluminum oxide film is 23 Å.

As for fabricating a metal oxide semiconductor field effect transistor, the gate, source and drain of the transistor are produced by ion implantation after the definition of the gate area has been completed. A contact wire is deposited on the gate, source and drain so as to form a metal oxide semiconductor field effect transistor.

In the above-mentioned embodiments, of course, the metallic film produced on the surface of said silicon substrate must isolate the electrode so that only the back of the silicon substrate can be contacted with the electrode, so as to form a uniform oxidizing electric field.

Figure 3:
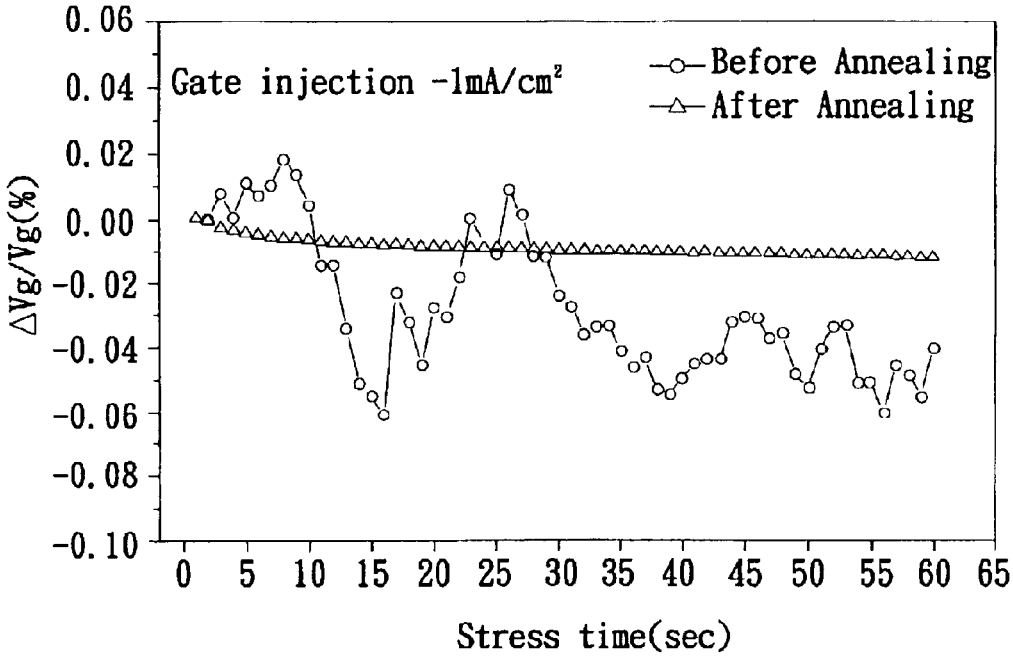
FIG. 3 is a diagram that shows a change of gate voltage corresponds to time, while injects a constant current of −1 mA/cm $^2$ into the gate of an $Al_2O_3$ MOS device.

An analysis of the results in the above-mentioned embodiments now is provided as follow:

To research the importance of annealing at a high temperature toward the character of the device, we inject a constant current of −1 mA/cm$^2$ into the end of the gate of the MOS device to observe the change of gate voltage. The result is shown in FIG. 3. The oxidizing layer contains a lot of electron and hole traps before the annealing is performed at a high temperature. When the electrons and holes are trapped while passing through the oxidizing layer, they result in the large fluctuation of gate voltage. But much improvement of the fluctuation of gate voltage after annealing at a high temperature can be seen. From those we can understand the importance of annealing at high temperature that contributed to improvement of quality of dielectrics after anodic oxidation.

Figure 4:
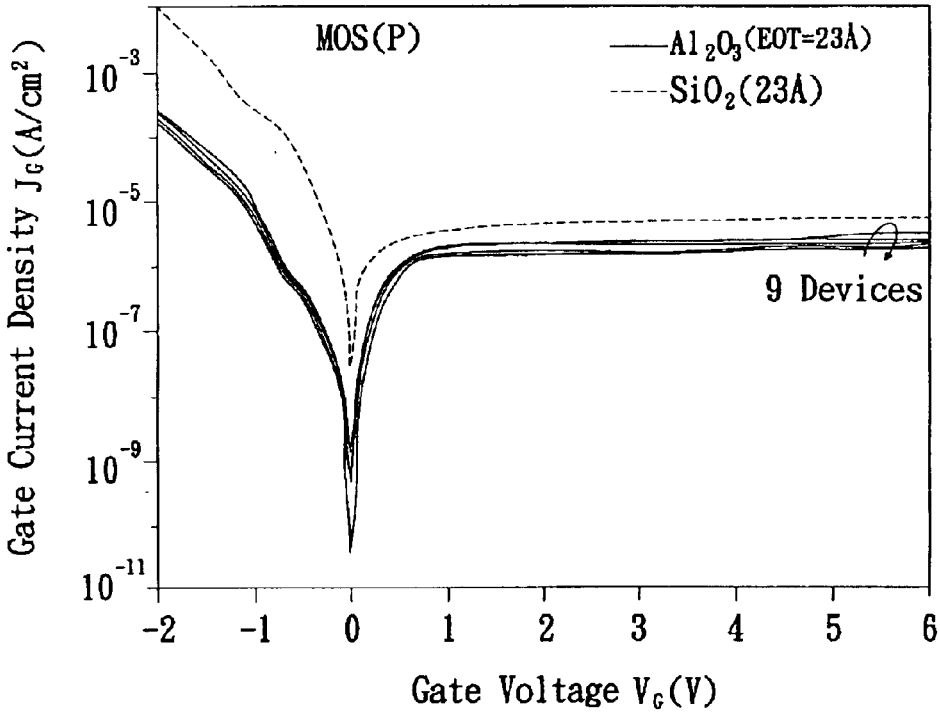
FIG. 4 is a diagram that shows current-voltage (I-V) characters of $Al_2O_3$ whose EOT is 23 Å.

Current-voltage (I-V) characteristics of the device are shown in FIG. 4. Leakage current of aluminum oxide was 100~1000 times lower than that of silicon dioxide, which can be got in the accumulation region, while whole full current can be got in the depletion region and inversion region. The whole full current will enable channel mobility to produce a mild decay.

Figure 5:
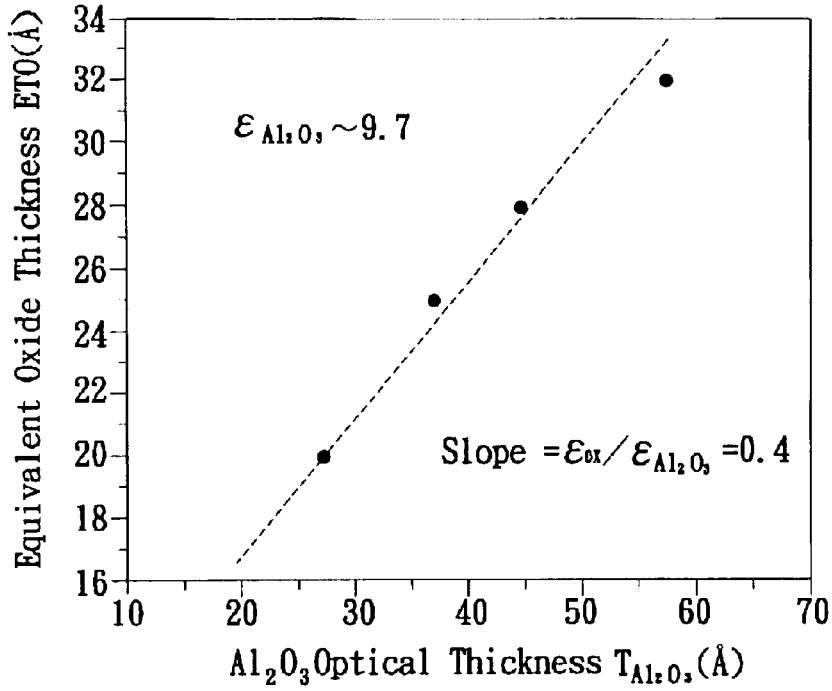
FIG. 5 is a diagram that shows a high-k $Al_2O_3$ dielectric layer whose k is 9.7, calculated from values of EOT corresponding to optical thickness.

FIG. 5 is a graph showing the value of optical thickness measured by ellipsometer, and EOTs measured by C-V measurement. From the following related formula, $$\epsilon_{ox}/\mathrm{EOT}=\epsilon_{Al2O3}/T_{Al2O3}$$

$$\Delta\mathrm{EOT}/\Delta T_{Al2O3}=\epsilon_{ox}/\epsilon_{Al2O3}$$

wherein $\epsilon_{ox}$ means dielectric constant of silicon dioxide,

EOT means equivalent oxide thickness, $\epsilon_{Al2O3}$ means dielectric constant of aluminum oxide, and $T_{Al2O3}$ means optical thickness of aluminum oxide, we can get a high-k $Al_2O_3$ dielectric whose k ($\epsilon A_{l2O3}$) is 9.7.

Figure 6:
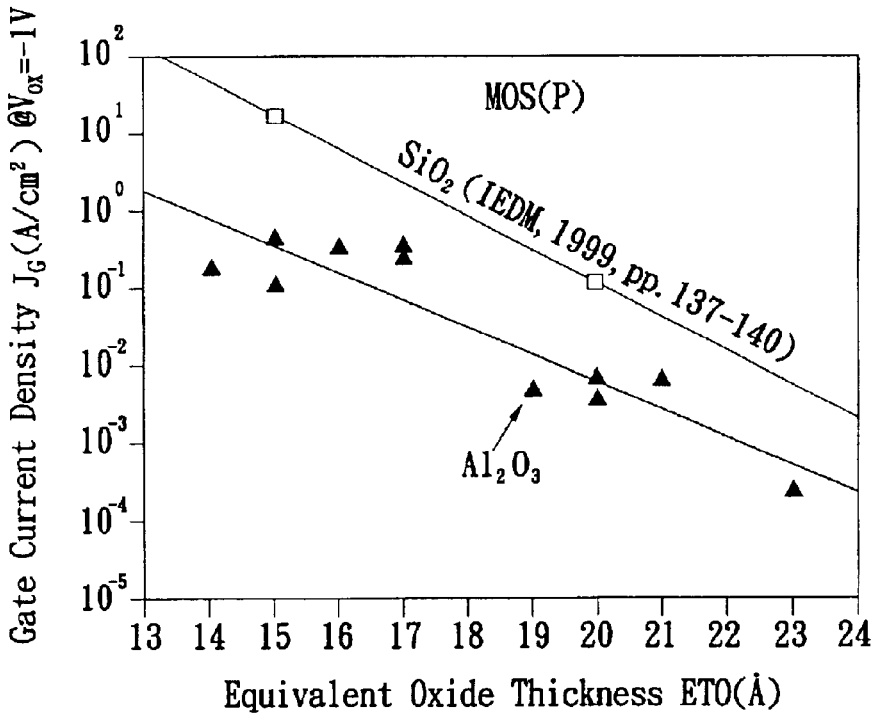
FIG. 6 is a diagram that shows the comparison of leakage current of $Al_2O_3$ and $SiO_2$ corresponding to different equivalent oxide thickness.

FIG. 6 is a graph that shows the comparison of leakage current of $Al_2O_3$ and $SiO_2$ with different equivalent oxide thickness. We know that the process is a stable process which can be reproduced, and get lower leakage current than $SiO_2$'s by all different values of EOT.

Based on the analysis results of the above-mentioned better embodiments, the following features of the invention may be described:

1. A film of the metal oxidizing layer that is produced by liquid phase anodic oxidation can be a gate dielectric of a MOSFET. This method can get excellent oxidation control toward metallic film at room temperature, so that a metal oxidizing layer of high quality and high-k can be produced. Furthermore, EOT of the metal oxidizing layer can decrease to 14 Å and still have better electric characteristics. In future advanced processes below 0.13 micron technology, EOT would be lower than 20 Å. Accordingly, the invention that can be integrated to the most advanced process will play an important role in the fabrication of the gate oxidizing layer.
2. The invention requires only cheap and effective liquid phase anodic oxidation, which first deposits a layer of metal on a substrate and effectually oxidizes the deposited metal to form a metal oxidizing layer under applicable control of oxidizing voltage and time. Compared with the prior art, the process can proceed at room temperature without using expensive instruments and doesn't have a need to be produced in a high vacuum ($<10^{-7}$ torr) environment. Therefore, both the thermal budget of the produced environment and the production cost can be decreased effectually and easily be integrated into the present design condition and process installation.

3. The invention uses liquid phase anodic oxidation at room temperature in the oxidation of the metallic layer, which can produce an ultrathin (EOT<20 Å) gate oxidizing layer with high quality and can be integrated into the present CMOS process directly without changing any process parameter or step to achieve the final purpose of minimizing devices.
4. The liquid phase anodic oxidation used by the invention allows for a lot of choices and applications. For instance, to use one way such as evaporation, sputtering, MBE or CVD as a production method. The metal for preparation can be a metal whose oxides are of high-k, such as aluminum (Al), tantalum (Ta), titanium (Ti), zirconium (Zr) or lanthanons (La). Anode is a chip and cathode can be a platinum (Pt) sheet or an N-type semiconductor. Electrolyte can be DI water, or other organic or inorganic electrolyte. Power supply for usage can be direct current (D) anodic oxidation, alternating current (AC) anodic oxidation, direct-alternating current (DAC) anodic oxidation or constant current (CC) anodic oxidation. And the thermal annealing installation can be a furnace or rapid thermal annealing (RTA) installation. The thermal annealing gas can be nitrogen gas, oxygen gas, ammonia gas, nitrous oxide gas or forming gas (90% $N_2$+10% $H_2$). While using a furnace, the annealing temperature is about 500 to 900° C. and the annealing time is about 1 to 90 minutes. While using an RTA installation, the annealing temperature is about 800 to 1000° C. and the annealing time is about 0 to 60 seconds.

The following are objectives realized by the invention, as above-mentioned, (1) To decrease the thermal budget of the producing environment and producing cost effectually.
(2) To be integrated directly into CMOS process without changing any process parameter or step.
(3) To facitate production of gate dielectrics of high quality, high-k and ultrathin equivalent oxide thickness.

The present invention has been described with preferred embodiments thereof and it is understood that many changes and modifications in the described embodiments can be carried out without departing from the scope and the spirit of the invention as defined by the appended claims.

What is claimed is:

1. A method of preparing high-k gate dielectrics prepared by a liquid phase anodic oxidation, comprising the following steps:

providing a silicon substrate and producing a metallic film on a clean surface of the silicon substrate, and then oxidizing the metallic film to form a metallic oxide as a gate oxidizing layer by liquid phase anodic oxidation, and performing thermal annealing to promote quality of the gate oxidizing layer.

2. A method as claimed in claim 1, wherein anode is a silicon substrate, cathode is a platinum sheet or a N-type semiconductor, electrolyte is DI water, other organic or inorganic electrolyte.

3. A method as claimed in claim 1, wherein power supply for usage can be direct current anodic oxidation, alternating current anodic oxidation, direct-alternating current anodic oxidation or constant current anodic oxidation.

4. A method as claimed in claim 1, wherein the metallic film produced on the surface of said silicon substrate must isolate to the electrode to make only the back of the silicon substrate to be contacted with the electrode so as to form a uniform oxidizing electric field.

5. A method as claimed in claim 1, wherein thermal annealing installation can be furnace or rapid thermal annealing installation.

6. A method as claimed in claim 5, wherein thermal annealing gas can be nitrogen gas, oxygen gas, ammonia gas, nitrous oxide gas or forming gas (90% $N_2$+10% $H_2$).

7. A method as claimed in claim 5, wherein the annealing temperature is about 500 to 900° C. while using furnace, and the annealing temperature is about 800 to 1000° C. while using rapid thermal annealing installation.

8. A method as claimed in claim 5, wherein the annealing time is about 1 to 90 minutes while using furnace, and the annealing time is about 0 to 60 seconds while using rapid thermal annealing installation.

9. A method as claimed in claim 1, wherein the producing way can be evaporation, sputtering, molecular beam epitaxy or chemical vapor deposition.

10. A method as claimed in claim 1, wherein the metal for preparation can be a metal whose oxides are of high-k, such as aluminum, tantalum, titanium, zirconium or lanthanons.

11. A method of producing a metal oxide semiconductor field effect transistor that contains high-k gate dielectrics, including the steps of first producing a p-well and an n-well on a silicon substrate and filling an oxide for isolation;

then producing a metallic film on a clean surface of said silicon substrate and to oxidizing said metallic film to form a metallic oxide as a gate-oxidizing layer by liquid phase anodic oxidation;

next, to promote quality of said gate oxidizing layer, performing thermal annealing to form a gate layer on the gate metal oxidizing layer;

defining a gate region and forming the gate, drain and source of the transistor by ion implantation;

then depositing an oxide-isolating layer on the gate layer;

etching a window of the gate, drain and source; and, then depositing a contact wire, and decreasing a concentration of junction traps by using thermal annealing.

12. A method as claimed in claim 11, wherein anode is a silicon substrate, cathode is a platinum sheet or a N-type semiconductor, electrolyte is DI water, other organic or inorganic electrolyte.

13. A method as claimed in claim 11, wherein power supply for usage can be direct current anodic oxidation, direct-alternating current anodic oxidation, direct-alternating current anodic oxidation or constant current anodic oxidation.

14. A method as claimed in claim 11, wherein the metal film produced on the surface of said silicon substrate must isolate to the electrode to make only the back of the silicon substrate to be contacted with the electrode so as to form a uniform oxidizing electric field.

15. A method as claimed in claim 11, wherein thermal annealing installation can be furnace or rapid thermal annealing installation.

16. A method as claimed in claim 15, wherein thermal annealing gas can be nitrogen gas, oxygen gas, ammonia gas, nitrous oxide gas or forming gas (90% $N_2$+10% $H_2$).

17. A method as claimed in claim 15, wherein the annealing temperature is about 500 to 900° C. while using furnace, and the annealing temperature is about 800 to 1000° C. while using rapid thermal annealing installation.

18. A method as claimed in claim 15, wherein the annealing time is about 1 to 90 minutes while using furnace, and the annealing time is about 0 to 60 seconds while using rapid thermal annealing installation.

19. A method as claimed in claim 11, wherein the producing way can be evaporation, sputtering, molecular beam epitaxy or chemical vapor deposition.

20. A method as claimed in claim 11, wherein a metal for preparation can be a metal whose oxides are of high-k such as aluminum, tantalum, titanium, zirconium or lanthanons.

* * * * *